US009308147B2

(12) United States Patent
Davis et al.

(10) Patent No.: US 9,308,147 B2
(45) Date of Patent: Apr. 12, 2016

(54) PRONE POSITIONING DEVICE

(71) Applicant: Mercy Medical Research Institute, Springfield, MO (US)

(72) Inventors: Keela Davis, Springfield, MO (US); Martin Reuter, Flemington, MO (US)

(73) Assignee: Mercy Medical Research Institute, Springfield, MO (US)

( * ) Notice: Subject to any disclaimer, the term of this patent is extended or adjusted under 35 U.S.C. 154(b) by 0 days.

(21) Appl. No.: 13/897,195

(22) Filed: May 17, 2013

(65) Prior Publication Data

US 2013/0305455 A1 Nov. 21, 2013

Related U.S. Application Data

(60) Provisional application No. 61/648,370, filed on May 17, 2012.

(51) Int. Cl.

| | |
|---|---|
| ***A61G 7/07*** | (2006.01) |
| ***A61G 13/12*** | (2006.01) |
| ***A47C 20/02*** | (2006.01) |

(52) U.S. Cl.

CPC ..... *A61G 7/07* (2013.01); *A47C 20/026* (2013.01); *A61G 13/121* (2013.01); *A61G 13/122* (2013.01); *A61G 13/1215* (2013.01); *A61G 2200/325* (2013.01)

(58) Field of Classification Search

CPC ... A61G 13/121; A61G 13/122; A61G 13/12; A61G 13/009; A61G 13/1215; A61G 2200/325; A61G 7/07; A61G 7/072; A61G 2013/0054; A47C 20/025; A47C 20/026; A47C 16/00; A61B 6/0421; A61M 16/0633; A47G 9/1054; A47G 9/1063

USPC ..... 5/630–632, 635–639, 645; 297/391–393

See application file for complete search history.

(56) References Cited

U.S. PATENT DOCUMENTS

| | | | | |
|---|---|---|---|---|
| 2,688,142 | A | 9/1954 | Jensen | |
| 3,315,282 | A * | 4/1967 | Lowery et al. | 5/638 |
| 3,694,831 | A | 10/1972 | Treace | |
| D271,834 | S | 12/1983 | Huntsinger | |
| 4,752,064 | A | 6/1988 | Voss | |
| D298,992 | S | 12/1988 | Voss | |

(Continued)

FOREIGN PATENT DOCUMENTS

WO 2010040120 A2 4/2010

OTHER PUBLICATIONS

Curley, Martha A.Q., et al. "The Effects of Early and Repeated Prone Positioning in Pediatric Patients with Acute Lung Injury," Download from chestjournal.chestpubs.org on Feb. 16, 2012, pp. 154-164.

(Continued)

*Primary Examiner* — Nicholas Polito
*Assistant Examiner* — David R Hare
(74) *Attorney, Agent, or Firm* — Michael A. Williamson; Polsinelli, PC

(57) ABSTRACT

A prone positioning device is described for supporting the chest and head of a patient in a prone position during a medical procedure. The device allows medical personnel to view the face of the patient while the patient is in the prone position by means of a reflective surface disposed in a cavity in the device beneath the patient's face.

12 Claims, 8 Drawing Sheets

(56) References Cited

U.S. PATENT DOCUMENTS

| | | | | |
|---|---|---|---|---|
| 5,014,375 | A * | 5/1991 | Coonrad et al. | 5/648 |
| 5,220,699 | A | 6/1993 | Farris | |
| D337,914 | S | 8/1993 | McDonald | |
| 5,269,035 | A | 12/1993 | Hartunian | |
| 5,287,576 | A | 2/1994 | Fraser | |
| 5,504,953 | A * | 4/1996 | Singer-Leyton et al. | 5/631 |
| 5,613,501 | A | 3/1997 | Michelson | |
| 5,632,050 | A * | 5/1997 | Zajas et al. | 5/632 |
| 5,652,981 | A * | 8/1997 | Singer-Leyton et al. | 5/631 |
| 5,707,572 | A * | 1/1998 | Kostich | 264/46.4 |
| 5,865,181 | A | 2/1999 | Spense, Jr. | |
| 5,900,997 | A * | 5/1999 | Shapiro | 359/857 |
| D414,974 | S | 10/1999 | Marrone, II et al. | |
| 5,960,494 | A | 10/1999 | Gilliland et al. | |
| 6,106,123 | A * | 8/2000 | McDonald | 359/872 |
| 6,112,333 | A | 9/2000 | Mazzei | |
| 6,249,923 | B1 | 6/2001 | Heimbrock et al. | |
| D456,516 | S | 4/2002 | Cheshaek et al. | |
| 6,374,441 | B1 | 4/2002 | Begell | |
| 6,427,272 | B1 | 8/2002 | Yacoub | |
| 6,487,736 | B1 | 12/2002 | Militzer | |
| 6,490,737 | B1 | 12/2002 | Mazzei et al. | |
| 6,561,194 | B2 | 5/2003 | Michelson | |
| 6,637,058 | B1 | 10/2003 | Lamb | |
| 6,718,581 | B2 * | 4/2004 | Riach | 5/632 |
| 6,721,978 | B1 * | 4/2004 | Tankersley | 5/652 |
| 6,739,006 | B2 * | 5/2004 | Borders et al. | 5/622 |
| 6,842,924 | B1 | 1/2005 | Walters | |
| 7,080,420 | B2 * | 7/2006 | Damron | 5/640 |
| 7,555,794 | B2 * | 7/2009 | Zelnik et al. | 5/632 |
| 7,574,759 | B2 | 8/2009 | Wilson et al. | |
| D601,261 | S | 9/2009 | Levan | |
| 7,603,730 | B2 * | 10/2009 | Zelnik | 5/601 |
| 7,661,163 | B1 * | 2/2010 | Gallaher | 5/632 |
| 7,676,867 | B2 | 3/2010 | De Laura | |
| 7,882,583 | B2 | 2/2011 | Skripps | |
| D642,278 | S | 7/2011 | Sharps et al. | |
| 7,997,276 | B2 * | 8/2011 | Goff | 128/845 |
| 8,006,335 | B1 * | 8/2011 | Andermann | 5/638 |
| 8,291,907 | B2 * | 10/2012 | Kuhlmann | 128/207.11 |
| 8,468,628 | B1 * | 6/2013 | Cheng | A47G 9/007 5/632 |
| 8,474,079 | B1 * | 7/2013 | Gangitano | 5/731 |
| 8,549,683 | B2 * | 10/2013 | Ratner | 5/638 |
| 8,584,280 | B2 * | 11/2013 | Shah | 5/603 |
| 2006/0053556 | A1 | 3/2006 | Piontek | |
| 2010/0319706 | A1 | 12/2010 | Berry et al. | |
| 2012/0304387 | A1 * | 12/2012 | Crompton et al. | 5/632 |
| 2013/0276236 | A1 * | 10/2013 | Rasmussen | 5/640 |

OTHER PUBLICATIONS

Vadhavkar, Aarti, M.D., "Prone Positioning Under Anthesia," Presentation, Feb. 15, 2008, 32 pages.

ProneView Protective Helmet System, http://www.dupacoine.com/Helmet_System.html, retrieved Aug. 26, 2011, 1 page.

* cited by examiner

PRONE POSITIONING DEVICE

CROSS-REFERENCE TO RELATED APPLICATIONS

This non-provisional application claims priority of U.S. Provisional Patent Application No. 61/648,370 filed on May 17, 2012, which application is incorporated herein by reference.

BACKGROUND

1. Field of the Invention

The prone positioning device described herein is in the field of devices to support and position a person. More specifically, the device supports the head, neck and upper torso of a person in a prone position during a medical procedure such as surgery. The prone positioning device provides access and visibility to the face of the patient while the patient is in the prone position during the medical procedure.

2. Summary of the Invention

Embodiments of the prone positioning device for a patient comprise a facial cushion for supporting the head of the patient, said cushion comprising a support component having an upper and a lower surface, and a plurality of feet extending downwardly from the lower surface of the support component for supporting the support component in an elevated position above a work surface; a first aperture extending from the upper surface of the support component to the lower surface thereof for receiving at least a portion of the patient's face; a second aperture extending through a side of the facial cushion, said second aperture defined by a first foot and a second foot selected from the plurality of feet, the lower surface of the support layer and the work surface; a wedge-shaped component attached to the lower surface of the support component of the facial cushion, said wedge-shaped component having an angled upper surface; and a reflective surface disposed on the angled upper surface of the wedge-shaped component; wherein the reflection of the portion of the patient's face disposed on the first aperture is visible through the second aperture as reflected by the reflective surface; and wherein the facial cushion is formed from a foam material.

In further embodiments of the prone positioning device, the first aperture comprises a lateral section wide enough to expose the eyes of the patient, and a section extending perpendicular to the lateral section to expose the nose of the patient.

In embodiments, the prone positioning device further comprises a wedge-shaped chest cushion having a lower surface, an angled upper surface, two sides and an end wall; said angled upper surface intersecting said lower surface at an acute angle at a first end of the chest cushion opposite to the end wall; wherein the end wall of the chest cushion is attached a side of the facial cushion for supporting the chest of the patient.

In additional embodiments of the prone positioning device, the wedge-shaped component and the chest ramp are removeably attached to the facial cushion.

In further embodiments of the prone positioning device, the facial cushion further comprises a top layer of soft material to comfortably support the patient's face, said top layer of soft material attached to the upper surface of the support component.

In alternative embodiments, the prone positioning device further comprises at least one bolster disposed along a portion of the sides of the angled upper surface of the chest cushion and the upper surface of the support component of the facial cushion.

In other alternative embodiments of the prone positioning device, wires, tubes or other diagnostic or therapeutic equipment pass into the patient's mouth or nose through the first and second apertures in the facial cushion.

BRIEF DESCRIPTION OF THE DRAWINGS

FIG. 9 is a bottom perspective view of a second alternative embodiment of the prone positioning device.

DETAILED DESCRIPTION

The prone positioning device supports the head, neck and upper torso of a person in a prone position. The device is typically utilized to support a patient during a medical procedure. Without a device to support a patient in the prone position during a medical procedure, the medical personnel will have to create a temporary support for the patient using materials such as towels, pillows or other items at hand. Such ad hoc supports are not optimal because they may support the patient in an uncomfortable position, may injure the patient through insufficient support, may not provide firm enough support to hold the patient in a fixed position during the procedure, and may not allow the medical personnel to see or have access to the patient's face during surgery. In particular, the inability to see or access the patient's face during surgery inhibits the medical personnel from monitoring the patient and the lines and tubes that may be inserted through the patient's nose and mouth.

The invention described herein supports the patient in the prone position while allowing medical personnel to monitor the patient's face and the lines and tubes inserted into the patient's nose and mouth. The medical personnel are able to monitor the patient without altering the patient's position or moving the support device.

Figure 1:
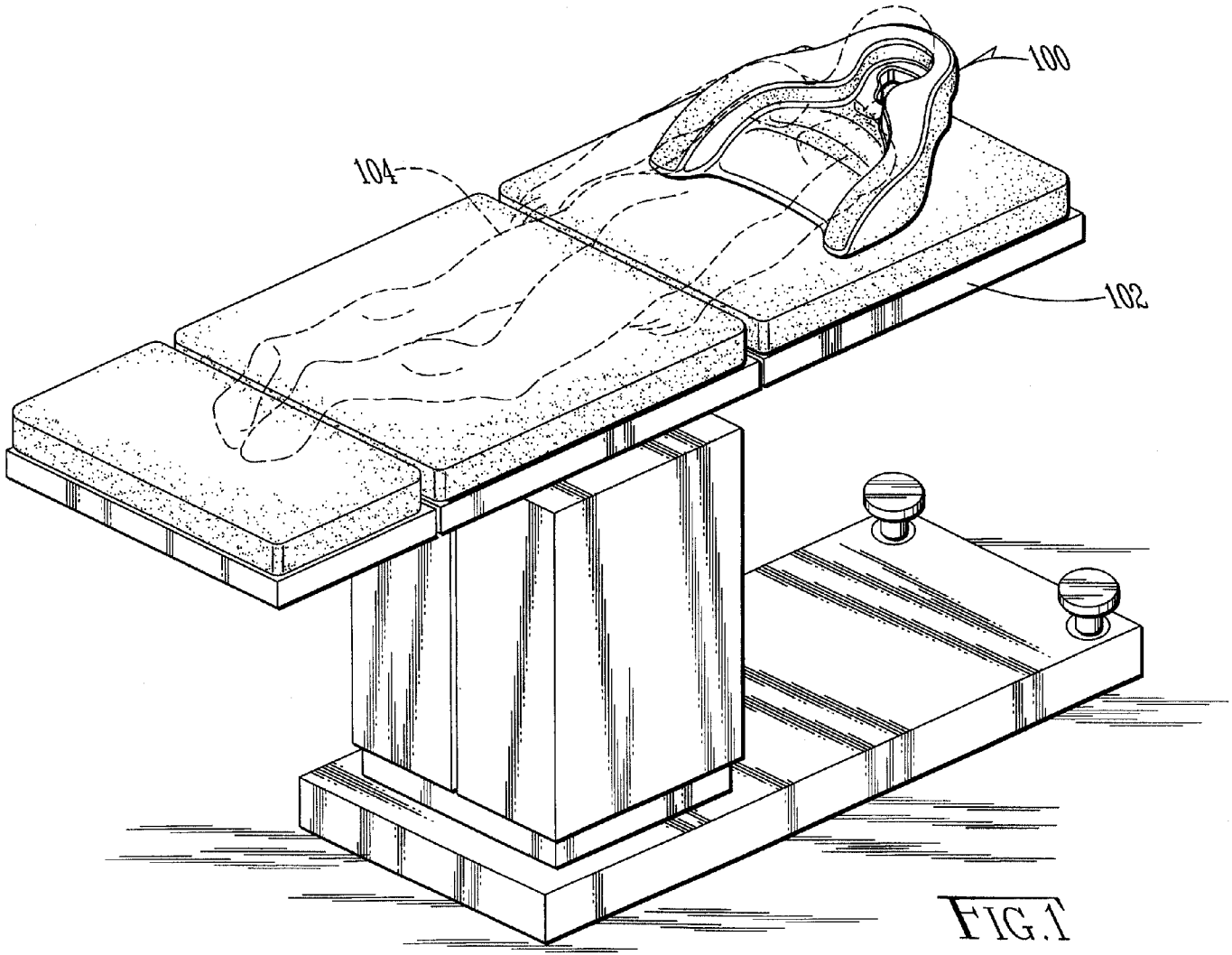
FIG. 1 is a perspective view of an embodiment of the prone positioning device disposed on a surgical table.

Referring now to FIG. 1, a perspective view of an embodiment of the prone positioning device is depicted disposed on a surgical table. The embodiment of the device 100 is shown on a table 102 with the outline of a patient 104 supported on the device. As can be seen the device 100 supports the upper chest, neck and head of the patient 104 in the prone position. The device 100 is typically formed from one or more types of foam to provide firm but comfortable support to the patient. The foam or other material may be covered with an outer skin to resist fluids and wear to the material, or it may be exposed material as appropriate for the application. The device may be produced in one or more sizes designed to fit a variety of sizes of patient, from children to adults of various sizes. The device 100 may be contoured to fit to the body of the patient, and to firmly but comfortably support the patient in position for the medical procedure.

Figure 2:
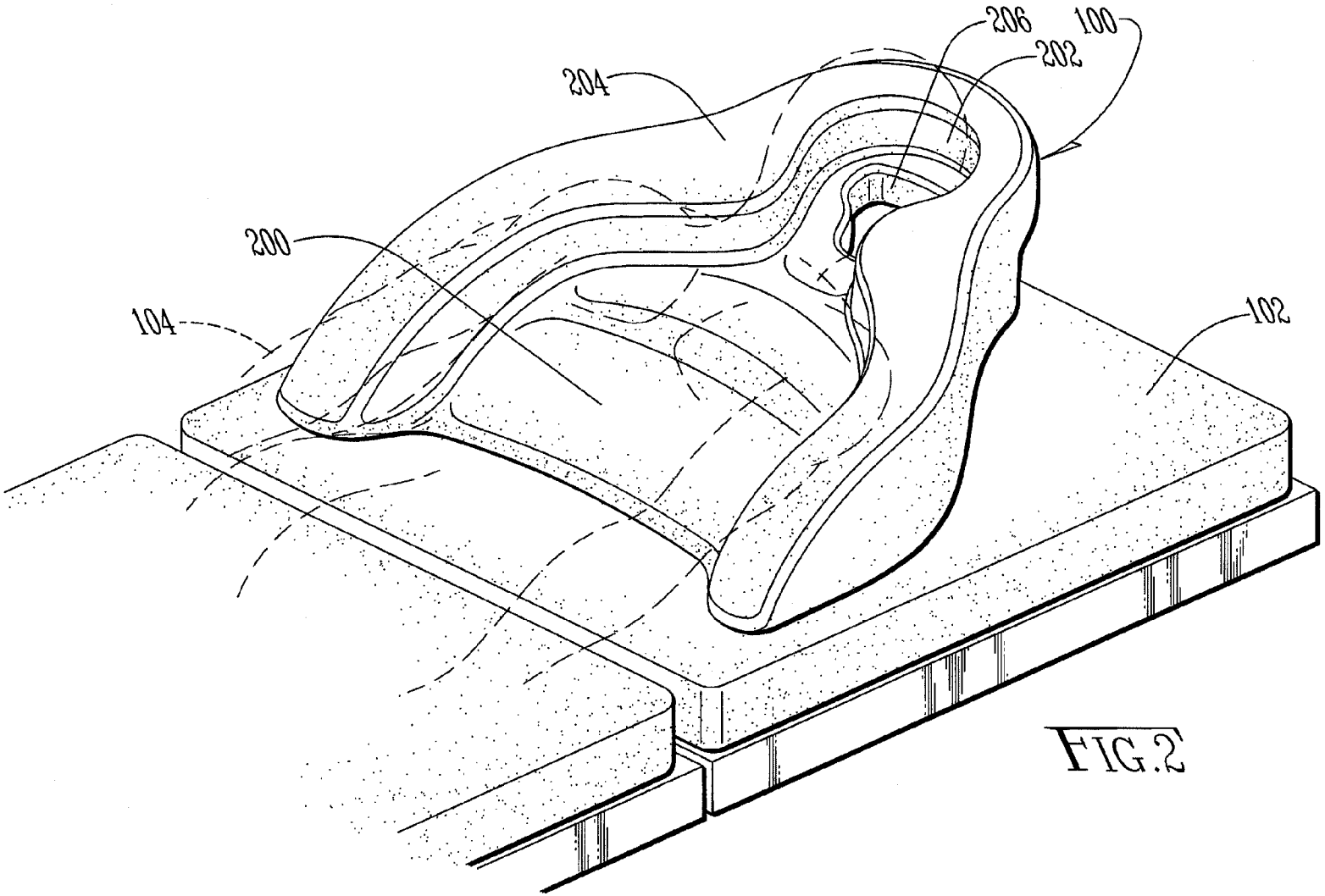
FIG. 2 is a perspective view of an embodiment of the prone positioning device.

Referring now to FIG. 2, a perspective view of an embodiment of the prone positioning device is depicted. The depicted embodiment comprises a chest cushion 200 for supporting the chest and shoulders of the patient 104. The chest ramp 200 transitions from the level of the surgical table 102 to the raised level of the facial support 202. This transitional ramp provides support to the patient's body and holds it in a comfortable and safe position during a medical procedure. In the depicted embodiment, the chest cushion 200 and facial cushion 202 are surrounded by bolster 204 which generally conforms to the shape of the patient's body and holds it in the desired position by preventing lateral movement.

The patient's facial area is located over an aperture 206 allowing it to be seen from below and also allowing diagnostic, monitoring and life support equipment to be provided to the patient through the face, mouth and nose. The aperture depicted in FIG. 2 is generally T-shaped when viewed from above, to allow both of the patient's eyes to be visible through the aperture 206, having a lateral section and a transverse section disposed substantially perpendicular thereto. In addition the patient's nose, and potentially its mouth are also visible through the aperture 206. As will be described in relation to later figures, the patient can see down through aperture 206 into a cavity in the prone positioning device 100. A mirror or other reflective surface placed in the cavity allows medical personnel to view the patient's eyes and facial area through the cavity and the aperture 206.

Figure 3:
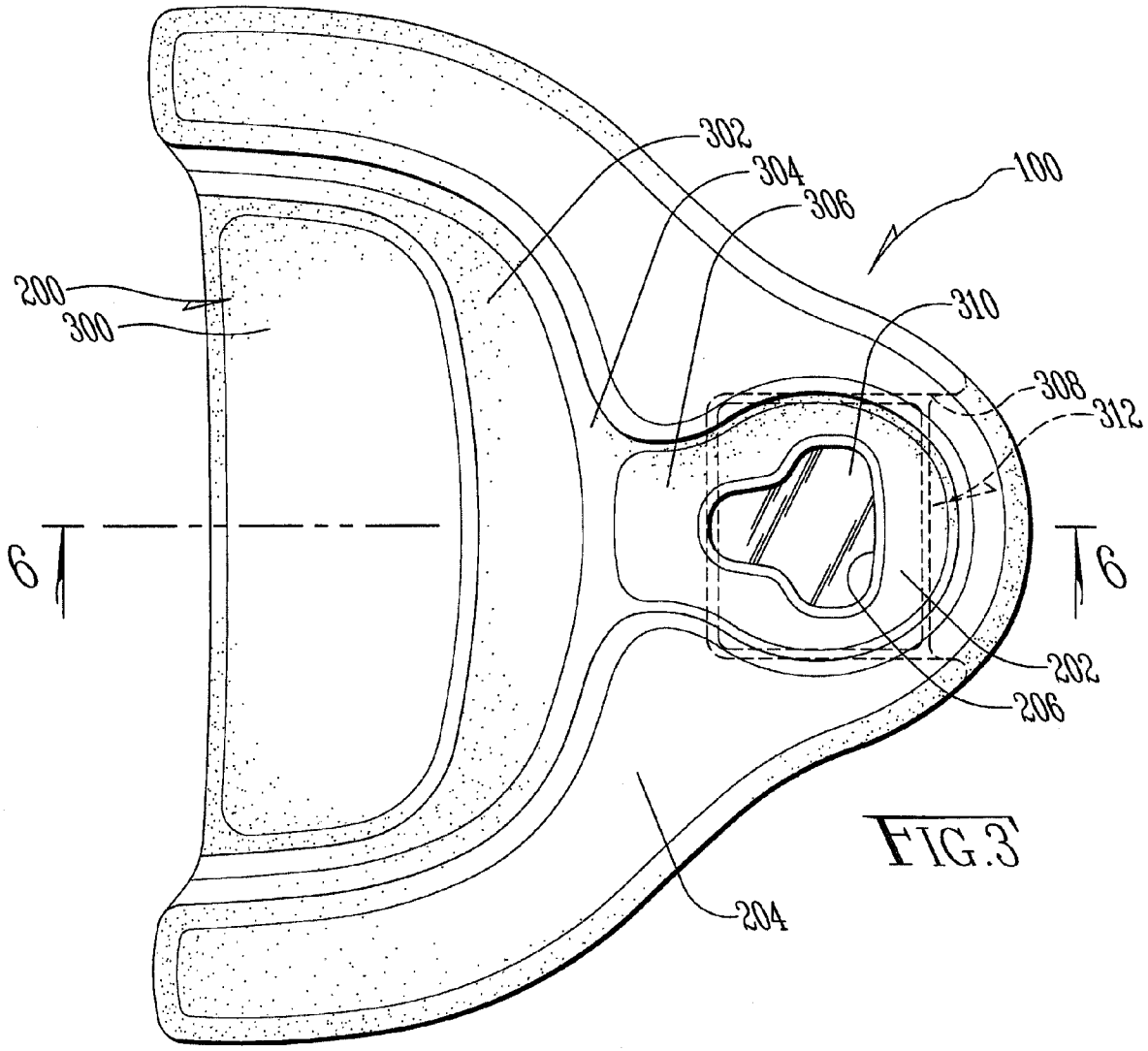
FIG. 3 is a top view of an embodiment of the prone positioning device.

Referring now to FIG. 3, a top view of an embodiment of the prone positioning device is depicted. The chest cushion 200 and the facial cushion 202 may be provided with recesses and raised areas designed to contour to the patient's body. In the depicted embodiment the chest cushion is provided with recessed area 300 to contour to the patient's chest, and raised areas 302 and 304 for the patient's shoulder and neck areas. Similarly, facial support 206 is provided with recessed area 306 to conform to the user's chin, cheeks and forehead. The chest cushion 200 and facial support area 202 are surrounded by bolster 204.

Dashed lines depict a cavity 308 and mirror 310 disposed beneath the patient's face. Cavity 308 is connected to aperture 206 so that the patient looks down into cavity 308 when supported on the device in a prone position. The mirror 310 is disposed at an angle within cavity 308 to reflect light from the aperture 206 out through aperture 312 in the side of the device 100. When a patient is disposed on the device 100, medical personnel may look in through aperture 312 and inspect the patient's face through aperture 206.

Figure 4:
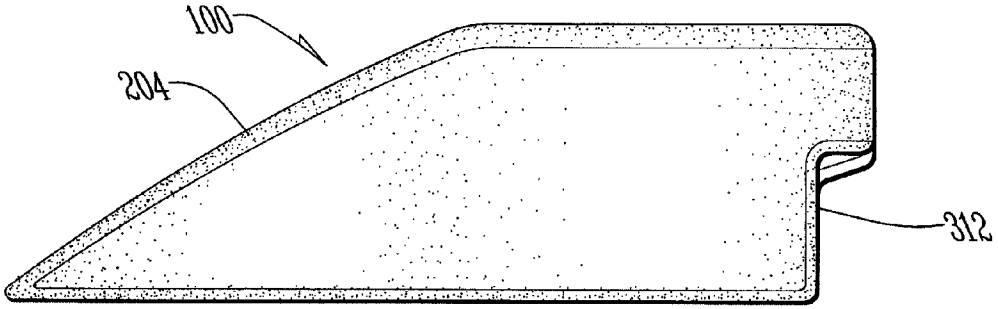
FIG. 4 is a side view of an embodiment of the prone positioning device.

Referring now to FIG. 4, a side view of an embodiment of the prone positioning device is depicted. Bolster 204 parallels chest cushion 200 and slopes upward to the facial cushion 206. An aperture 312 is provided in the lower portion of facial cushion 206 to allow medical personnel to see into cavity 308.

Figure 5:
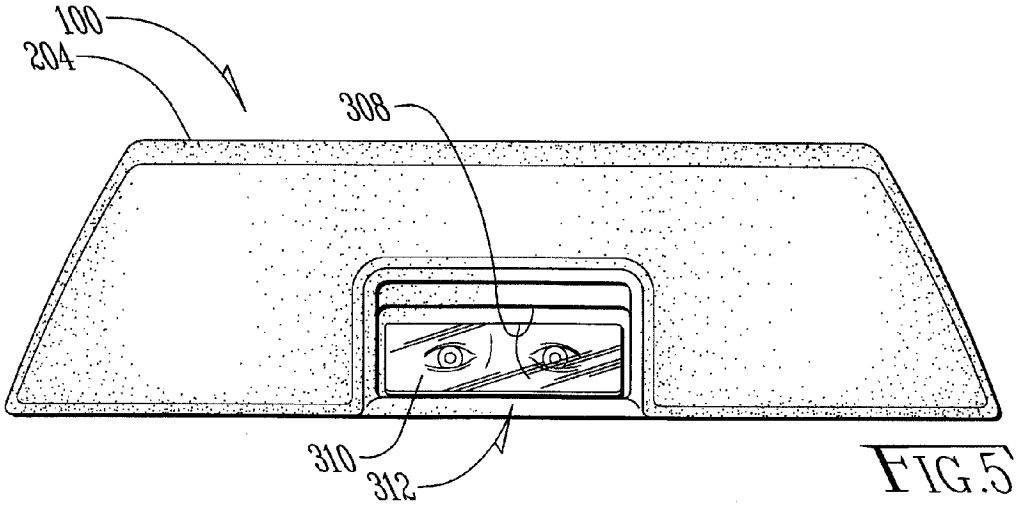
FIG. 5 is an end view of an embodiment of the prone positioning device.

Referring now to FIG. 5, an end view of an embodiment of the prone positioning device is depicted. The base of the depicted embodiment of the device 100 is substantially wider than the upper surface to provide stability, although this may not be necessary in all embodiments of the invention.

Aperture 312 is provided in the end of the device 100 adjacent to the patient's face. The aperture allows medical personnel to see into cavity 308 disposed beneath the patient's face. Mirror 310 is disposed within the cavity 308 at an angle so that the medical personnel looking in through aperture 312 may see the patient's face in the mirror 308 through aperture 206. Tubes, lines and other medical equipment may be disposed through aperture 312, cavity 308 and aperture 206 to be inserted into the patient's nose or mouth.

Figure 6:
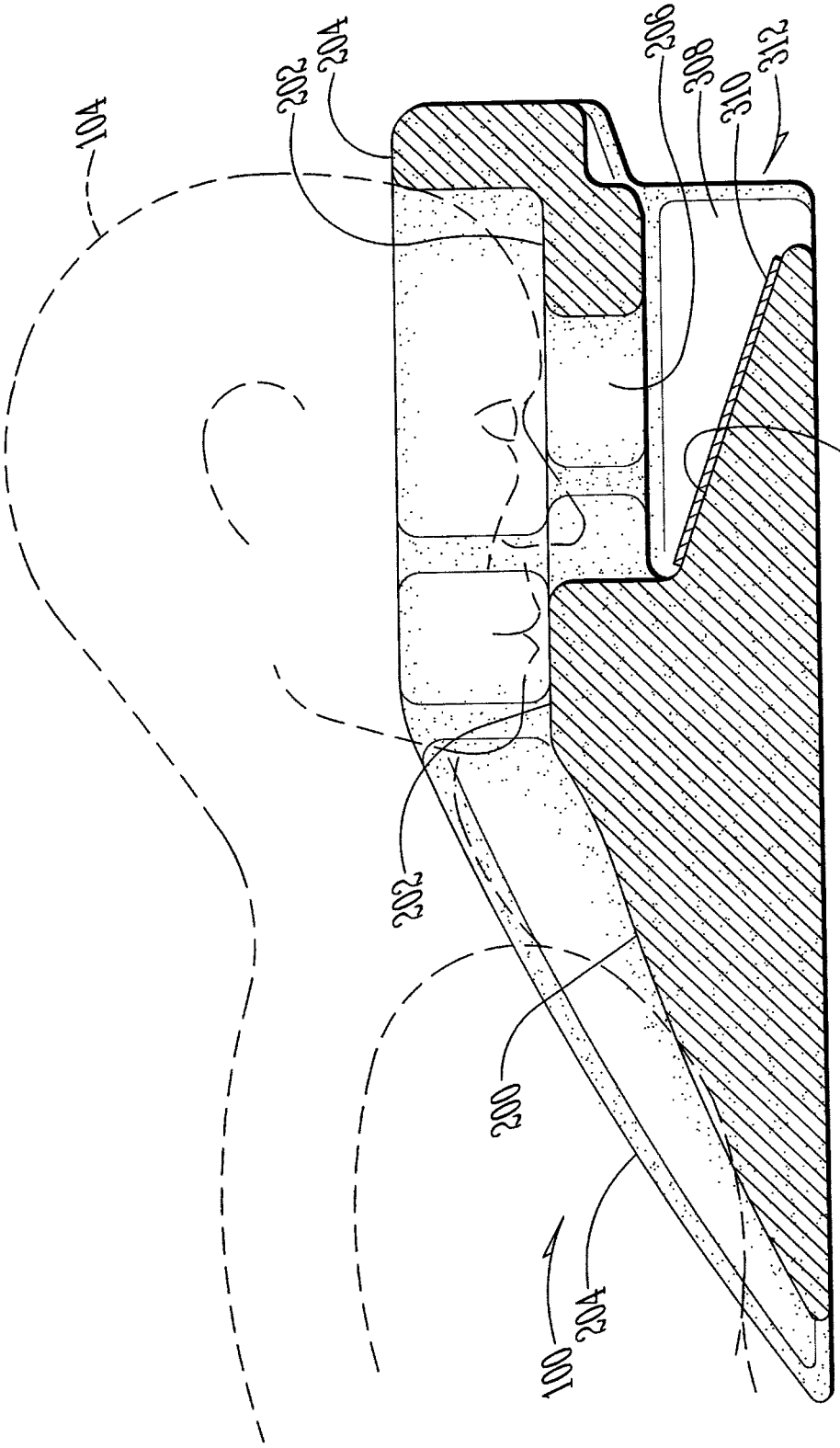
FIG. 6 is a cross-sectional view of an embodiment of the prone positioning device.

Referring now to FIG. 6, a cross-sectional view of an embodiment of the prone positioning device is depicted. The patient's shoulders and chest rest on chest cushion 200 and bolster 204 extends above cushion 200 to provide a side wall and to help maintain the patient 104 on device 100 in the proper position.

Beneath facial cushion 202 aperture 206 extends downwardly to cavity 308. Inside cavity 308 surface 600 is disposed at an angle that slopes downwardly toward the aperture 312 at the end of the device 100 adjacent to the patient's head. Mirror or reflective surface 310 is disposed on surface 600. The angle of ramp 600 is such that the patient's face may be viewed by medical personnel through aperture 312.

Figure 7:
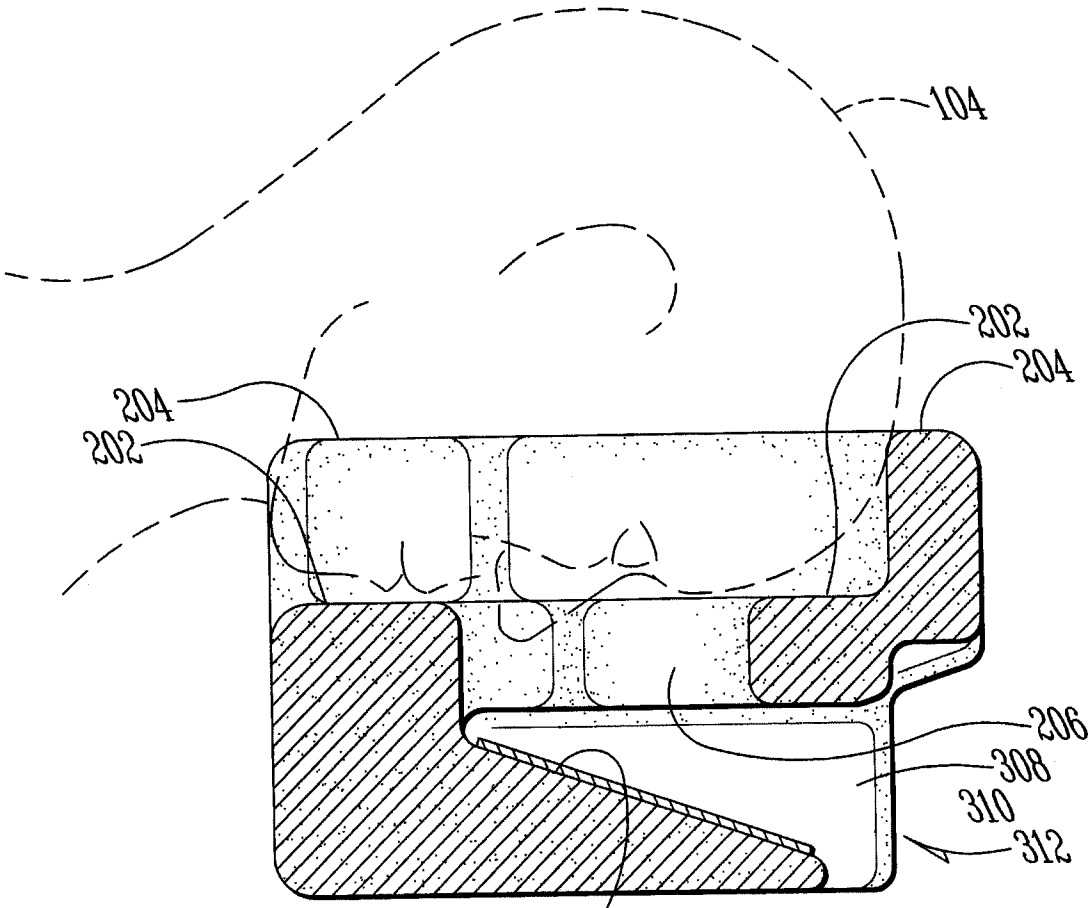
FIG. 7 is a cross-sectional view of an alternative embodiment of the prone positioning device.

Referring now to FIG. 7, a cross-sectional view of an alternative embodiment of the prone positioning device is depicted. The alternative embodiment does not include the chest cushion 200. In some surgical table designs it may not be preferable or necessary to provide the chest cushion 200. The embodiment includes the same facial cushion 202 and aperture 206. The mirror 310 is similarly disposed in cavity 308 for the viewing of the patient's face through aperture 312 during a medical procedure.

Figure 8:
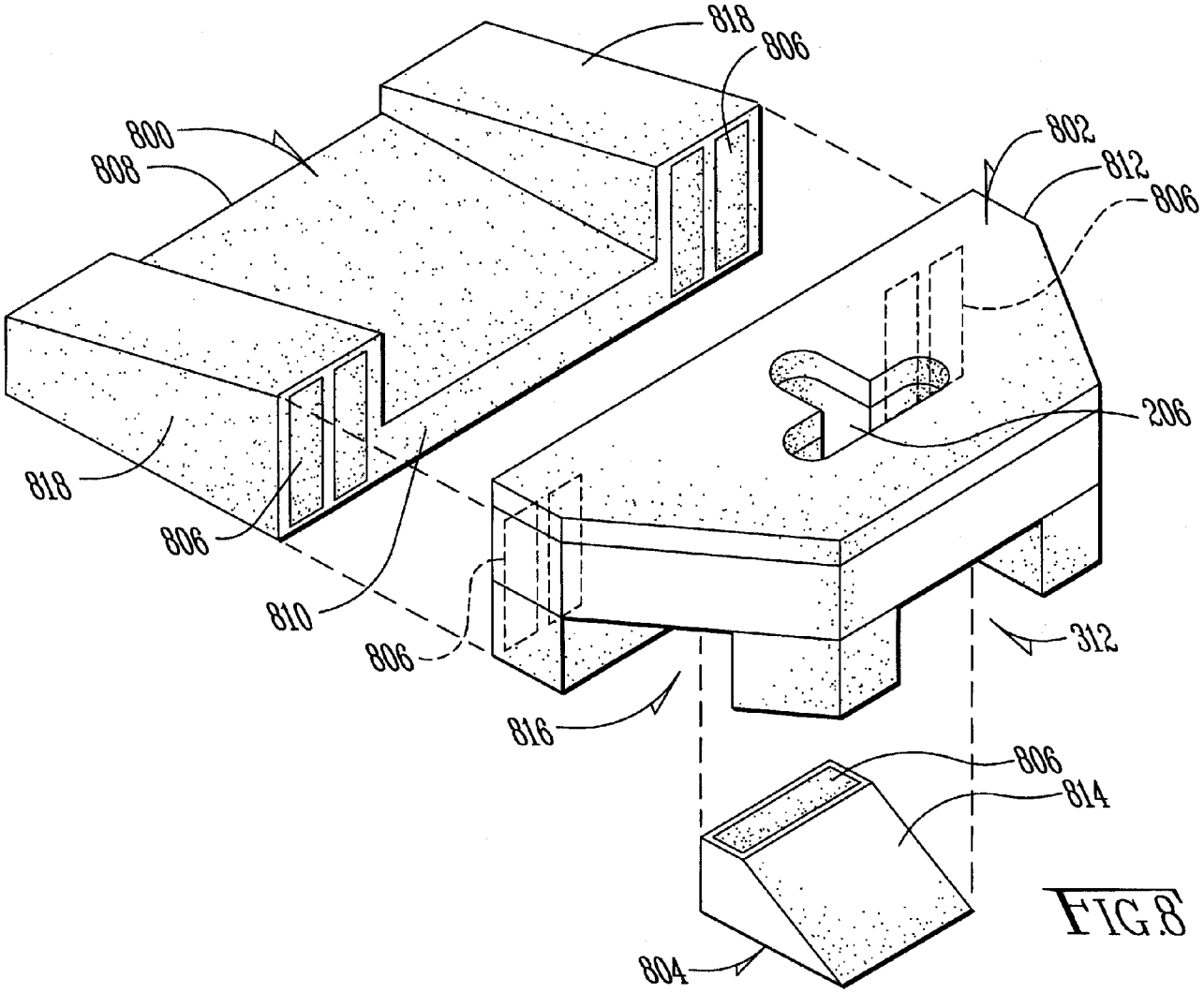
FIG. 8 is an exploded perspective view of a second alternative embodiment of the prone positioning device.
Figure 6:
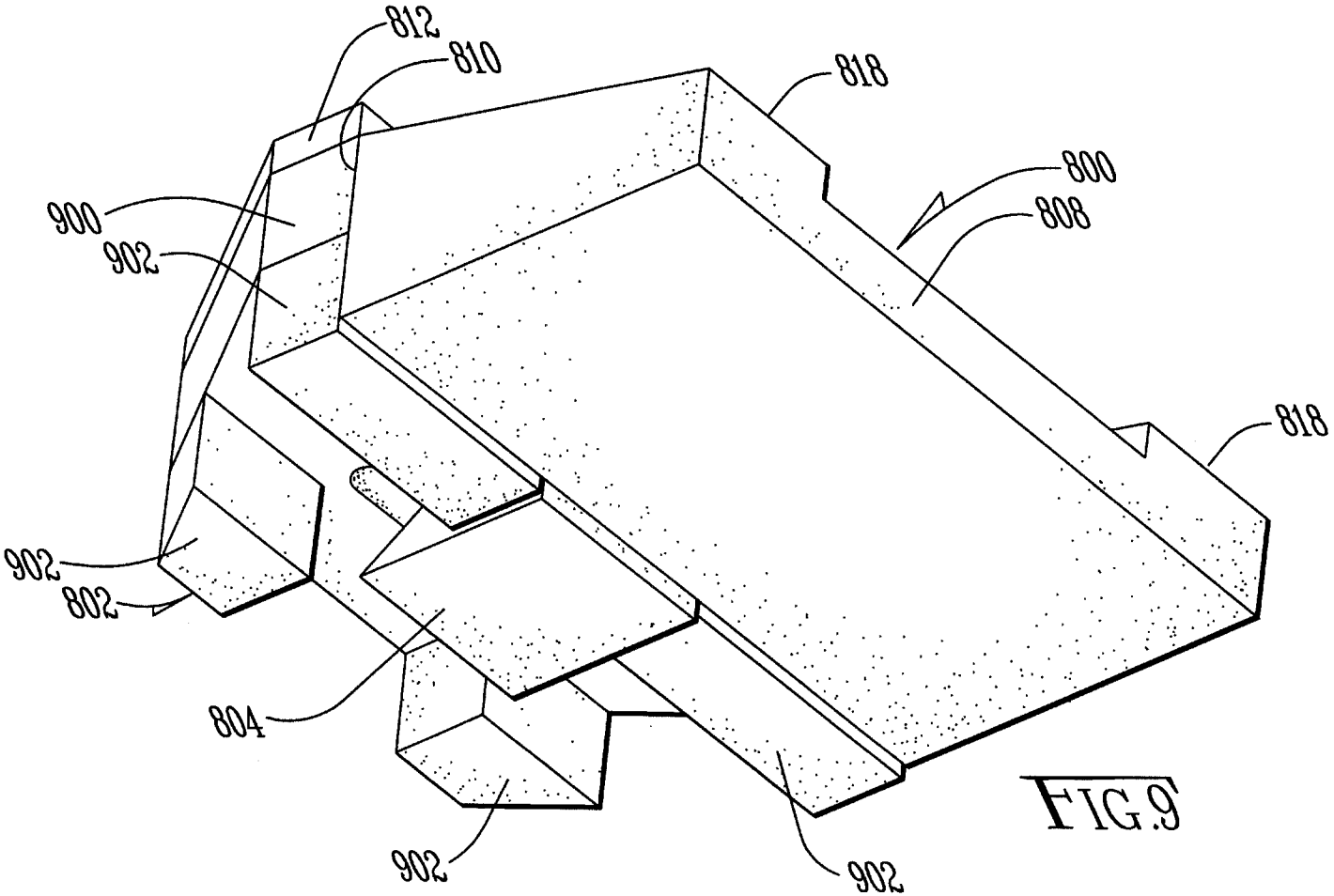

Referring now to FIG. 8, an exploded perspective view of a second alternative embodiment of the prone positioning device is depicted. In the depicted embodiment, the device is comprised of three parts which may be disconnected from each other, namely the chest support or cushion 800, the facial support or support 802 and wedge-shaped component 804. The components are removeably attached to each other by various means such as hook and loop fasteners, double-sided tapes, or other suitable adhesives. In the depicted embodiment, hook and loop material 806 is affixed to each component to attach the components together. This embodiment does not include the bolster provided in the previous embodiment.

Chest cushion 800 has a base and side cushions or walls 818 that generally increase in height from a first end 808 of cushion 800 to the second end 810 thereof. The cushion 800 provides a comfortable transition area supporting a patient with its abdomen on the surgical table and its head on facial support 802. The patient's shoulders may rest on side cushions 818 with their chest in the recessed area between the side cushions 818. Alternatively, the patient's chest and shoulders may fit within the recessed area between the side cushions 818.

The facial support 802 may be provided with a top layer or cushion 812 that provides softer support to the patient's face than the material used for the remainder of the support 802. This top layer provides for more comfort to the patient while the remainder of the support 802 holds the patient's head in the desired position and maintains the open access and sightlines to the patient's face through aperture 206. In the depicted embodiment, the facial support 802 has aperture 312 for viewing of the patient's face on the reflective surface on platform 804. It also has apertures 816 extending from the cavity formed by the apertures 312 and 206 to each side of support 802. These apertures provide additional light and access to the patient's face for the purposes described herein.

Wedge-shaped component 804 is provided with a reflective surface or mirror attached or disposed on the angled surface 814 to allow viewing of the patient's face. Attachment material 806 is provided on a top surface of component 804 to releasably attach the component 804 to the bottom of support 802.

Referring now to FIG. 9, a bottom perspective view of an alternative embodiment of the prone positioning device is depicted. The components are depicted as attached together in the configuration for use with a patient. Support 802 incorporates a cavity for receiving wedge 804 beneath aperture 206. As can be seen in FIG. 9, the various apertures and layers in support 802 may be formed by attaching blocks of cushion material, cut to the appropriate shape, to each other to form the desired cushion. For example, in the depicted configuration, support 802 is formed of top layer 812, support layer 900, and feet 902. Since top layer 812 and layer 900 are uniform in thickness, the outline of each piece may be cut from a sheet of the appropriate material and then joined to each other. Similarly, feet 902 may be cut from sheet material and then attached to the bottom of support layer 900. This provides for a simpler cutting process then forming the final shape of layer 900 and feet 902 from a single block of material. Wedge component is disposed between two of the feet 902 and attached to the bottom of support layer 900, with the angled upper surface directed toward aperture 312.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A prone positioning device comprising:

a facial support having an upper and a lower surface, and at least one foot extending downwardly from the lower surface of the facial support;

a first aperture extending from the upper surface of the facial support to the lower surface thereof; wherein the first aperture has a T-shape for accepting the eyes, nose, and mouth, while the surrounding cushion supports a patient's face, a second aperture defined by the at least one foot and the lower surface of the facial support; wherein wires, tubes or other diagnostic or therapeutic equipment is able to pass through the first and second apertures to pass into the patient's mouth or nose; wherein the first aperture is visible through the second aperture on the reflective surface;

a wedge-shaped component removably attached to the lower surface of the facial support, said wedge-shaped component having an upper surface with a flat portion and an angled portion;

a reflective surface disposed on the angled portion of the upper surface of the wedge-shaped component;

a chest support having a base with an upper surface, a first end and a second end, and two side edges extending between the first and second ends;

and two side walls disposed along the two side edges of the base and extending upwardly from the upper surface thereof; wherein the two side walls have an upper surface that is angled upwardly from the first end to the second end of the base.

2. The prone positioning device of claim 1 wherein the first aperture comprises a lateral section, and a section extending perpendicular to the lateral section.

3. The prone positioning device of claim 1 wherein the chest support is releasably attached to the facial support.

4. The prone positioning device of claim 1 further comprising a top cushion layer disposed on the top surface of the facial support.

5. A prone positioning device comprising:

a facial support cushion having a top surface and a side surface;

a cavity disposed within the said facial support cushion, the cavity having a bottom surface disposed at an angle;

a first aperture extending from the top surface of the facial support cushion to the cavity; wherein the first aperture has a T-shape for accepting the eyes, nose, and mouth, while the surrounding cushion supports a patient's face, a second aperture extending from the cavity to the side surface of the facial support cushion; wherein wires, tubes or other diagnostic or therapeutic equipment is able to pass through the first and second apertures to pass into the patient's mouth or nose;

a reflective surface disposed on the bottom surface of the cavity;

a chest support having a base with an upper surface, a first end and a second end, and two side edges extending between the first and second ends; and two side walls disposed along the two side edges of the base and extending upwardly from the upper surface thereof; wherein the two side walls have an upper surface that is angled upwardly from the first end to the second end of the base.

6. The prone positioning device of claim 5 further comprising an chest cushion extending from a second side of the facial support cushion, a top surface of the chest cushion angled downwardly from the top surface of the facial support cushion.

7. The prone positioning device of claim 5 wherein the first aperture comprises a lateral section, and a transverse section extending perpendicular to the lateral section.

8. The prone positioning device of claim 5 wherein the first aperture is visible through the second aperture on the reflective surface.

9. The prone positioning device of claim 5 further comprising a bolster disposed around the edges of the top surface of the facial support cushion, the bolster shaped to hold the face of a person above the first aperture.

10. The prone positioning device of claim 6 further comprising a bolster disposed along a first and second side of the chest cushion.

11. A method for positioning a person in a prone position comprising the steps of:

providing a facial support having an upper and a lower surface, at least one foot extending downwardly from the lower surface of the facial support, a first aperture extending from the upper surface of the facial support to the lower surface thereof, wherein the first aperture has a T-shape for accepting the eyes, nose, and mouth, while the surrounding cushion supports a patient's face, a second aperture defined by the at least one foot and the lower surface of the facial support, wherein wires, tubes or other diagnostic or therapeutic equipment is able to pass through the first and second apertures to pass into the patient's mouth or nose, a wedge-shaped component removably attached to the lower surface of the facial support, said wedge-shaped component having an upper surface with a flat portion and an angled portion, a reflective surface disposed on the angled portion of the upper surface of the wedge-shaped component, a chest support having a base with an upper surface, a first end and a second end, and two side edges extending between the first and second ends, two side walls disposed along the two side edges of the base and extending upwardly from the upper surface thereof; wherein the two side walls have an upper surface that is angled upwardly from the first end to the second end of the base;

placing the facial area of the person in a prone position on the first aperture on the facial support; and viewing the facial area of the person through the second aperture.

12. The method of claim 11 further comprising the steps of:

wherein the chest support is releasably attached to the chest support.

* * * * *